United States Patent [19]

Berger et al.

[11] Patent Number: 4,463,692

[45] Date of Patent: Aug. 7, 1984

[54] SHUTTLE EMBROIDERY MACHINE

[76] Inventors: Rolf Berger, Fadheiderstrasse 51, 4156 Willich 2; Josef Bonnen, Auf der Gath 9, Meerbusch 1; Josef Haffmans, Henriette-Brey-Strasse 11, 4170 Geldern 2; Max Schäfer, Schönwasserstrasse 113, 4150 Krefeld; Wolfgang Teetz, Eilder Dyk 24, 4173 Kerken 3; Franzjosef Gierse, Sonnenwinkel 11, 5900 Siegen 21, all of Fed. Rep. of Germany

[21] Appl. No.: 319,850

[22] Filed: Nov. 10, 1981

[30] Foreign Application Priority Data

Nov. 25, 1980 [DE] Fed. Rep. of Germany ..... 3044362

[51] Int. Cl.[3] ..... D05C 3/02

[52] U.S. Cl. ..... 112/102

[58] Field of Search ..... 112/103, 102, 98, 86

[56] References Cited

U.S. PATENT DOCUMENTS 3,468,268 9/1969 Rolauffs ..... 112/86

3,802,360 4/1974 Rolauffs et al. ..... 112/86

3,991,691 11/1976 Bolldorf ..... 112/86

*Primary Examiner*—Ronald Feldbaum

*Attorney, Agent, or Firm*—Holman & Stern

[57] ABSTRACT

A shuttle embroidery machine having an embroidery frame which is displaceable in accordance with a predetermined program with respect to the machine frame both in vertical and in horizontal directions at its two ends by separate respective drives each, each drive having a motor whose rotation can be transmitted via a transmission as a vertical or a horizontal displacement, respectively, to the embroidery frame and cross guides permitting independent movement of the embroidery frame in the horizontal or vertical directions. In order to increase the precision of positioning of the embroidery frame and at the same time to make its drives simpler and less expensive, at least one additional drive, controlled jointly with the end drives, is arranged between the ends of the embroidery frame for the vertical displacement of the embroidery frame.

11 Claims, 2 Drawing Figures

SHUTTLE EMBROIDERY MACHINE

The present invention relates to a shuttle embroidery machine having an embroidery frame which is displaceable in accordance with a predetermined program with respect to the machine frame both in a vertical and in a horizontal direction at its two ends by a separate respective drives each, that is, at each end there being one drive for the vertical displacement and another drive for the horizontal displacement, each drive having a motor whose rotation can be transmitted via a transmission as a vertical or a horizontal displacement respectively to the embroidery frame and cross guides permitting independent movement of the embroidery frame in horizontal or the vertical directions, respectively.

Shuttle embroidery machines of the abovementioned types are known in various embodiments. In the oldest embodiment, one mechanical drives for the vertical and one mechanical drive for the horizontal displacement of the embroidery frame which are controlled by an automatic control device are arranged on that side of the shuttle embroidery machine on which the automatic control device is arranged. The displacement movements of the mechanical drives on this end of the embroidery frame are transmitted by belts and/or shafts to the driveless end of the embroidery frame. These mechanical drives and their transmission members, however, only permit a very limited speed of operation of the shuttle embroidery machine because of their large weight.

For this reason, in another known embodiment, hydraulic control drives are used for the driving of the embroidery frame, these drives making an increase in the operating speed possible due to the fact that their weight is less than that of mechanical drives. The operating speed is, however, still limited by the fact that the movements of the hydraulic control drives, which are arranged only at one end of the embroidery frame, must be transmitted to the other end of the embroidery frame by means of belts and/or shafts which, on the one hand, increase the moment of inertia of the drive and, on the other hand, do not entirely eliminate stretching and twisting despite their high moment of resistance. This results in a lagging of the nondriven end of the embroidery frame and a canting thereof, leading to oscillations of the embroidery frame and thus to a limiting of the speed of displacement.

In the latest development of a shuttle embroidery machine, both ends of the embroidery frame are driven by separate respective motors in the vertical and the horizontal directions, that is, at each end there being one drive for the vertical displacement and another drive for the horizontal displacement, separate motors in vertical and horizontal direction, the motors which effect respective horizontal and vertical displacement being jointly controlled. By this two-sided drive of the embroidery machine by means of drives which are synchronized in pairs there is obtained a considerable increase in output as compared with the previous designs, this being due both to the fact that the movement of the two ends of the embroidery frame takes place without lag as compared with the previous one-sided drive and also, in particular, due to the form-locked clamping of the embroidery frame which results from the two-sided drive and which considerably reduces the oscillations which heretofore resulted in a limitation of the embroidery output.

Since the increase in output of the shuttle embroidery machine as a result of the two-sided drive of the embroidery frame must be obtained at the expense of a considerable outlay for the drives, the object of the present invention is, with the same or even greater output, to make the drives for the pattern movement of the embroidery frame simpler and more economical in a shuttle embroidery machine of the above-mentioned type and to increase the accuracy of positioning in the central part of the embroidery frame for the vertical direction of movement.

The manner of achieving this result in accordance with the invention comprises providing at least one additional drive, controlled jointly with the end drives, which is arranged between the ends of the embroidery frame for the vertical displacement of the embroidery frame.

By this additional drive it is not only possible to dispense with mechanical transmission elements from the driven ends of the embroidery frame to its central region but furthermore smaller motors can be used for the corresponding drive so that the expense for the drive is reduced.

The additional drive for the vertical displacement of the embroidary frame is, in accordance with another feature of the invention, arranged on a vertical upright of the machine frame so as to obtain a particularly favorable transmission of force. An additional drive for the vertical displacement of the embroidery frame is preferably arranged on each vertical upright of the machine frame so that the total force to be applied for the vertical displacement of the embroidery frame is distributed over a plurality of motors.

In accordance with another feature of the invention, in order to obtain such a distribution of the forces also in the case of the drives which cause the horizontal displacement of the embroidery frame, at least two drives with jointly controlled motors are arranged at each end of the embroidery frame. These drives for the horizontal displacement of the embroidery frame which are arranged at each end are preferably connected at different heights to the corresponding side bars of the embroidery frame.

By the use of a plurality of drives both for the vertical and for the horizontal displacement of the embroidery frame in accordance with the invention it is finally possible for the motors of the drives to be electric stepping motors whose control is particularly simple, so that despite the use of a plurality of electric stepping motors, on the whole, a considerable reduction in the expense for the drive of the embroidery frame can be obtained, with simultaneous elimination of the need for mechanical measures for stabilization or transmission.

One preferred embodiment of the shuttle embroidery machine of the invention is shown diagrammatically in the drawings, in which.

Figure 1:
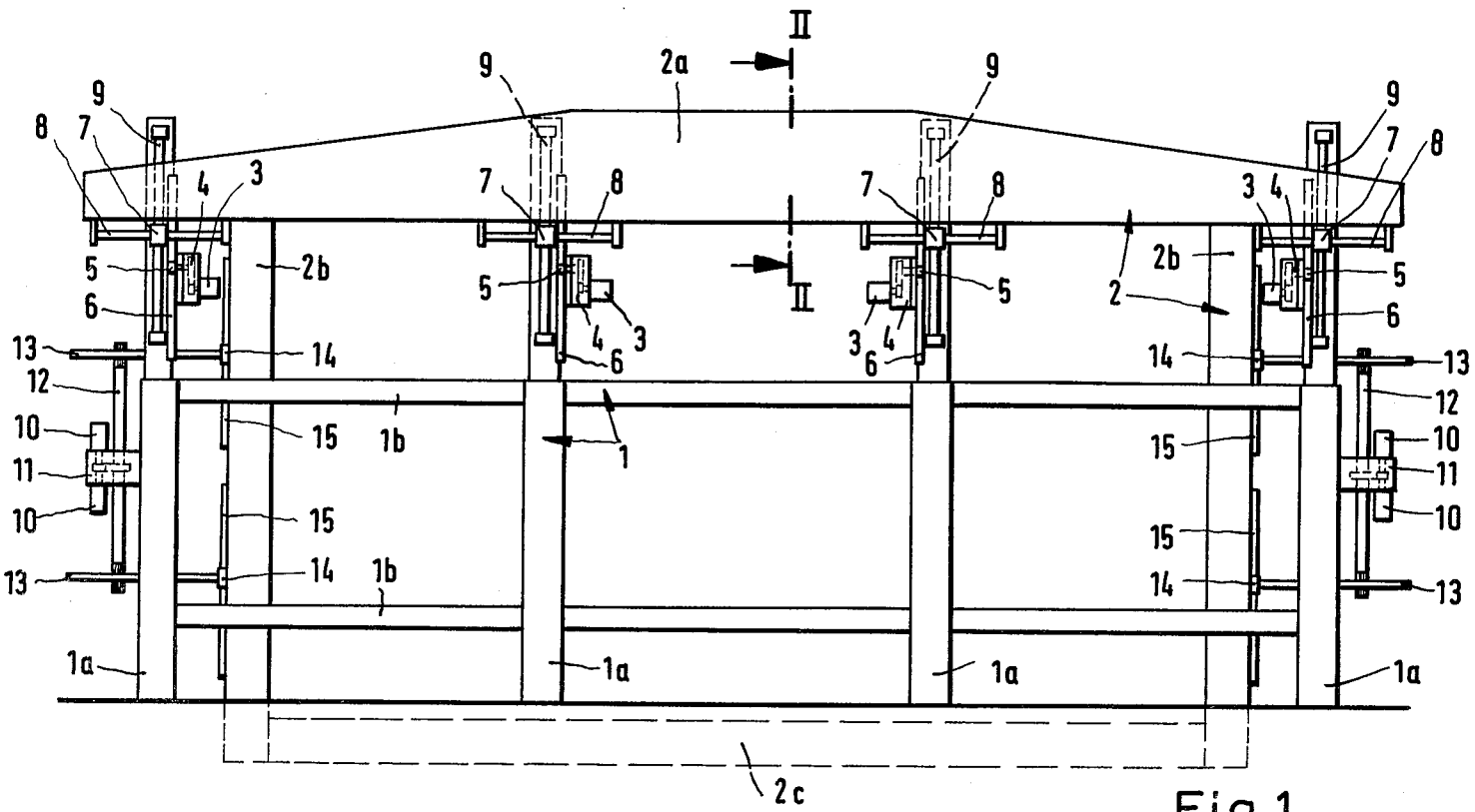
FIG. 1 is a front view of the shuttle embroidery machine.
Figure 2:
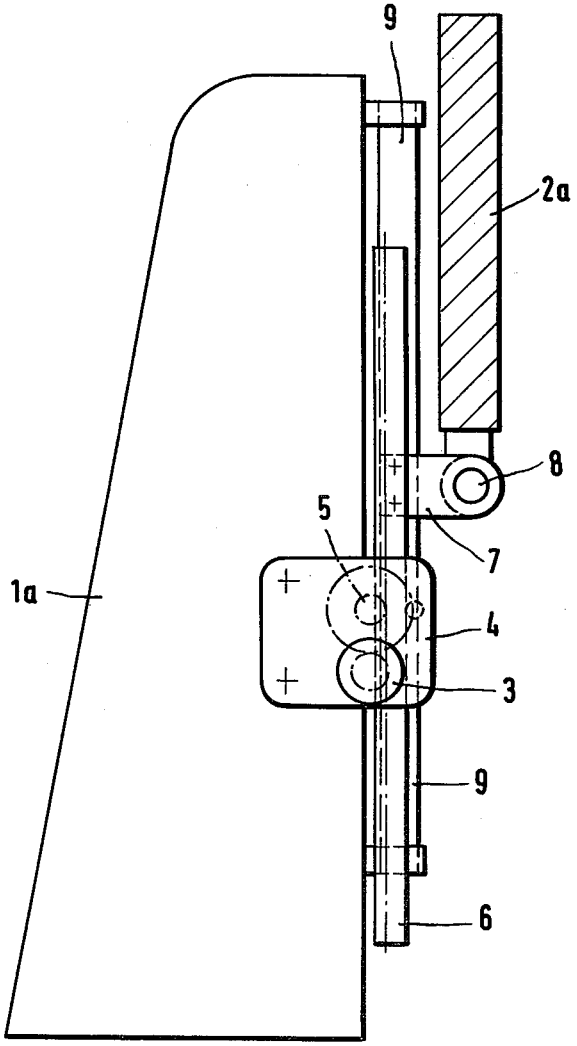
FIG. 2 is a partial section along the line II—II in FIG. 1, shown on a larger scale.

The shuttle embroidery machine has a machine frame 1 comprising, in the embodiment shown by way of example, a total of four vertical uprights (struts) 1*a* and two horizontal beams 1*b*. An embroidery frame 2 is displaceable in vertical and horizontal directions on the machine frame 1, the embroidery frame 2 being formed of an upper bar 2*a*, two side bars 2*b* and a lower bar 2*c*.

For greater clarity, the arrangement of the embroidery material on the embroidery frame 2 and the arrangement of the embroidery elements on the machine frame 1 have not been shown in the drawing. Nor has the control device for controlling the stepping motors been shown.

The vertical displacement of the embroidery frame 2 with respect to the machine frame 1 is effected, in the embodiment shown by way of example, by a total of four drives, one arranged on each vertical upright 1*a* of the machine frame 1. Each drive comprises an electric stepping motor 3 which drives a pinion 5 thereof via a transmission 4 thereof. This pinion 5 meshes with a rack 6 of the drive. The rack 6 is fastened to a crosshead 7. This crosshead 7 is guided displaceably on a horizontal guide bar 8 which is arranged on the upper bar 2*a* of the embroidery frame 2. In this way, rotation of the electric stepping motor 3 is converted into a reciprocating motion of the rack 6 and, via the crosshead 7 and the guide bar 8, into a reciprocating movement of the embroidery frame 2. The horizontal guide bar 8, which is displaceable in the crosshead 7, makes possible in this connection this reciprocation of the embroidery frame 2 independently of any horizontal movement thereof. The crosshead 7 is guided on a vertical guide bar 9 which, in the same way as the stepping motor 3 and the transmission 4, is arranged on the corresponding vertical upright 1*a* of the machine frame 1.

The horizontal displacement of the embroidery frame 2 is also effected by four electric stepping motors 10, which are arranged in pairs with their transmissions 11 on the two outer vertical uprights 1*a*. These stepping motors 10, via the transmission 11, drive a pinion shaft 12, which at its upper and lower ends meshes with a rack 13. Each rack 13 is connected via a crosshead 14 to a vertical guide bar 15 which is arranged on a side bar 2*b* of the embroidery frame 2. In this way horizontal displacement of the rack 13, produced from the electric stepping motors 10 via the transmission 11 by the pinion shaft 12, results in a corresponding horizontal displacement of the embroidery frame 2 with respect to the machine frame 1 without preventing the vertical displacement of the embroidery frame 2 since the crossheads 14 are displaceable in the vertical direction on the guide bars 15.

By the use of, in each case, four stepping motors 3 and 10, respectively, which are controlled jointly for the vertical and horizontal displacement, respectively, of the embroidery frame 2 with respect to the machine frame 1, the total force required for this displacement is distributed over four drives so that it is possible to use electric stepping motors of corresponding torque, which are particularly simple to control. In addition to a uniform distribution of the force to be introduced into the embroidery frame 2, the advantage is thereby obtained of a reduction in the structural and control expense for the drives.

We claim:

1. In a shuttle embroidery machine having an embroidery frame which in accordance with a predetermined program is displaceable at its two ends with respect to a machine frame both in vertical and in horizontal directions by separate drives, respectively, one of the drives at each of the ends being for the horizontal displacement and another of the drives being for the vertical displacement, each said drive having a motor, the rotation of which via a transmission is transmittable, as a vertical or horizontal displacement, respectively, to the embroidery frame, and cross guides permitting independent movement of the embroidery frame in the horizontal and vertical directions, respectively, the improvement comprising at least one additional drive means for the vertical displacement of the embroidery frame, being controlled jointly with at least said drives for the vertical displacement, is arranged between the ends of the embroidery frame.

2. The shuttle embroidery machine according to claim 1, wherein said machine frame has at least one vertical upright, said at least one additional drive means for the vertical displacement of the embroidery frame is arranged on said vertical upright of the machine frame.

3. The shuttle embroidery machine according to claim 2, wherein said machine frame has a plurality of said vertical uprights, a pluraity of said additional drive means, one of said additional drive means for the vertical displacement of the embroidery frame is arranged on each of said vertical uprights of the machine frame, respectively.

4. The shuttle embroidery machine according to claim 1, wherein said drives include at least two driving means having jointly controlled said motors arranged on each of the ends of the embroidery frame for the horizontal displacement of the embroidery frame.

5. The shuttle embroidery machine according to claim 4, wherein the embroidery frame has side bars, said at least two driving means for the horizontal displacement of the embroidery frame which are arranged at each of the ends of the embroidery frame are connected at different heights to a corresponding of said side bars of the embroidery frame.

6. The shuttle embroidery machine according to claim 1 or 4, wherein said at least one additional drive means has an additional motor in addition to said motors of said drives, respectively, said additional motor constitutes an electric stepping motor.

7. The shuttle embroidery machine according to claim 2, further comprising a vertical guide bar connected to said vertical upright, a rack having a crosshead displaceably mounted on said vertical guide bar, a horizontal guide bar is connected to said embroidery frame, said transmission is operatively connected to said drive means and to said rack, said horizontal guide bar is displaceably mounted relative to said crosshead, said horizontal guide bar and said crosshead constitute said cross guides.

8. The shuttle embroidery machine according to claim 4, wherein the embroidery frame has side bars, two aligned vertical guide bars spaced vertically apart from each other and connected to each of said side bars, two horizontally extending racks each having a crosshead displaceably mounted on said vertical guide bars, respectively, said two driving means include a common vertically oriented rotatably mounted pinion shaft having gears on both ends thereof gearingly engaging with said two racks, respectively, said transmission is operatively connected to corresponding of said jointly controlled motors and rotatably drives said pinion shaft, said jointly controlled motors are mounted on said machine frame, said vertical guide bars and said crossheads constitute said cross guides.

9. In a shuttle embroidery machine having an embroidery frame which in accordance with a predetermined program is displaceable at its two ends with respect to a machine frame both in vertical and in horizontal directions by separate drives, respectively, one of the drives at each of the ends being for the horizontal displacement and another of the drives being for the vertical displacement, each said drive having a motor, the rotation of which via a transmission is transmittable, as a vertical or horizontal displacement, respectively, to the embroidery frame, and cross guides permitting independent movement of the embroidery frame in the horizontal and vertical directions, respectively, the improvement comprising in addition to said drives for the vertical displacement of the embroidery frame at least one additional drive means for the vertical displacement of the embroidery frame, said at least one additional drive means being controlled jointly with at least said drives for the vertical displacement, and said at least one additional drive means is arranged between the ends of the embroidery frame.

10. The shuttle embroidery machine according to claim 9, wherein said at least one additional drive means is mounted in a central region of said embroidery frame.

11. The shuttle embroidery machine according to claim 1, wherein said at least one additional drive means is mounted in a central region of said embroidery frame.

* * * * *